US011015359B2

(12) United States Patent
MacDonald

(10) Patent No.: US 11,015,359 B2
(45) Date of Patent: May 25, 2021

(54) SWIMMING POOL WATER EXCHANGE DEVICE

(71) Applicant: Scott Tarvyd MacDonald, Torrance, CA (US)

(72) Inventor: Scott Tarvyd MacDonald, Torrance, CA (US)

( * ) Notice: Subject to any disclaimer, the term of this patent is extended or adjusted under 35 U.S.C. 154(b) by 0 days.

(21) Appl. No.: 14/286,135

(22) Filed: May 23, 2014

(65) Prior Publication Data

US 2015/0337554 A1 Nov. 26, 2015

(51) Int. Cl.
*E04H 4/14* (2006.01)
*E04H 4/12* (2006.01)

(52) U.S. Cl.
CPC ..... *E04H 4/14* (2013.01); *E04H 4/1218* (2013.01); *E04H 4/1236* (2013.01); *Y10T 137/1842* (2015.04); *Y10T 137/86035* (2015.04)

(58) Field of Classification Search
CPC ..... C02F 2103/42; E04H 4/12; E04H 4/1218; E04H 4/1245; E04H 4/1254; E04H 4/145; E04H 4/169; E04H 4/14; F04B 207/703; F04B 23/021; F04D 13/08; G05D 9/12
USPC ..... 137/391, 409, 412, 426, 441, 428, 399; 210/119, 127, 167.1; 4/490, 505, 4/507–509, 541.1–541.3, 904; 417/61, 417/26, 37; 73/305–322.5
See application file for complete search history.

(56) References Cited

U.S. PATENT DOCUMENTS 3,036,712 A * 5/1962 Barbara ..... E04H 4/144 210/167.1
3,040,469 A 6/1962 Richards
3,377,632 A * 4/1968 Peterson ..... E04H 4/065 4/490
3,780,385 A * 12/1973 Dunn ..... E04H 4/065 4/501
4,342,125 A * 8/1982 Hodge ..... E04H 4/12 137/430
4,422,193 A * 12/1983 Kravath ..... E04H 4/14 4/498
4,498,984 A * 2/1985 Colson ..... E04H 4/12 210/122
4,945,672 A 8/1990 Raia
5,367,723 A * 11/1994 Pleva ..... E04H 4/12 137/428
5,596,773 A * 1/1997 Cueman ..... E04H 4/12 4/496
5,779,884 A 7/1998 Raymo
6,910,498 B2 * 6/2005 Cazden ..... E04H 4/12 137/386
7,987,531 B2 * 8/2011 West ..... E04H 4/0012 4/541.3

(Continued)

*Primary Examiner* — David P Angwin
*Assistant Examiner* — Nicholas A Ros
(74) *Attorney, Agent, or Firm* — MU P.C.

(57) ABSTRACT

In an embodiment of the present invention, a swimming pool water exchange device is provided. In an embodiment, the device fills fresh water, from a water source, into one or more bags as the old water is pumped from the bottom of the pool. In an embodiment, the water exchange device is further provided with a regulation system. In the embodiment, the regulation system cuts off the fresh water supply if the water level exceeds a predetermined height. Furthermore, the regulation system may shut off the pump if the water level drops below a predetermined height.

4 Claims, 13 Drawing Sheets

(56) References Cited

U.S. PATENT DOCUMENTS

| | | | | |
|---|---|---|---|---|
| 8,209,794 | B1 * | 7/2012 | Harrison | E04H 4/12 340/618 |
| 8,220,482 | B1 * | 7/2012 | DeVerse | E04H 4/12 137/392 |
| 8,967,191 | B1 * | 3/2015 | DeVerse | E04H 4/12 137/412 |
| 2006/0260034 | A1 * | 11/2006 | Hamza | E04H 4/12 4/504 |
| 2011/0123357 | A1 * | 5/2011 | Leone | F04D 13/08 417/61 |
| 2014/0140862 | A1 * | 5/2014 | Elbaz | F04B 23/025 417/61 |

* cited by examiner

SWIMMING POOL WATER EXCHANGE DEVICE

CROSS-REFERENCE TO RELATED APPLICATION(S)

The present application claims priority to U.S. Provisional Patent Application No. 61/855,779 filed on May 23, 2013.

BACKGROUND OF THE INVENTION

This device solves a costly problem in the swimming pool industry. It is a long-sought solution addressing the ability to change the water in a swimming pool. I have been in the swimming pool industry for thirty years. I have three U.S. Pat. Nos. 4,815,152, 4,811,433, 4,686,717, all in swimming pool covers. I have a Los Angeles county health license #T4897 for the treatment of swimming pool water. Because of this exposure to swimming pools, I have noticed an extraordinary need for the renewal of water in pools. Once the total dissolved solids reach high levels, almost no amount of sanitizing will work to sanitize the pool water! There's even an industry built around repairing pools without draining them. A repair company will enter a pool, to do a repair, with complete diving equipment, large hydraulic rock chainsaws, and huge filters to keep the water clear enough to see during the repair. They have hydraulic rock saws that are used under water to cut into the body of the pool to do repairs. All this is to prevent the draining of the pool water.

There's also a company in San Diego Calif. that will come to your pool with a huge trailer mounted reverse osmosis filtering system. This system's whole purpose is to make the water in the pool like new, again to avoid draining the pool.

When you do drain a pool, the most common failure is plaster popping off the walls of the pool. This is caused by water trapped in the side walls of the pool pressing out when the water in the pool is removed. The most serious problem in pools is, pools popping out of the ground. This occurs when water is trapped underneath the pool. It lifts with the same force that giant aircraft carriers are lifted with. A computer search on Google for the words (popped pools) produces dozens of pictures of pools lifted out of the ground. Lifting a pool even one inch will probably destroy that swimming pool. It will partially or completely shear off all the plumbing attachments to the pool. Also, soil falls down underneath the pool preventing it from returning to its original position, if the water is removed to stop the lifting. This lifting essentially causes a complete destruction of the swimming pool.

Also, the insurance needed to cover draining of a pool is getting nearly impossible to acquire. One of the largest insurance companies of one of the largest pool service associations of southern California is now nearly refusing to cover draining of a pool, if no physical repair on the body of the pool is needed. They will not cover draining of a pool if the only purpose is to get new water in the pool.

The normal way water changes are currently done is by draining the pool down ⅓ then refilling. This draining and refilling is repeated two more times. This leaves approximately 29% of the water unchanged. Even then, pumping out ⅓ of a 20×40×5 foot pool removes 83,155 pounds of water.

A large Sport Utility Vehicle weighs around 7,000 pounds; draining ⅓ of the water from our 20×40 pool is like removing 11 SUVS in weight from the pool.

When these components are used correctly, the water in a pool can be changed with the following benefits:

1. Very low risk to the structure of the swimming pool.
2. Little to no change in the level of the water in the pool during the exchange.
3. Little to no waste of fresh water.
4. The exchange can occur faster than a typical draining and refilling. This is because both occur at the same time, rather than sequentially.
5. The exchange is often 100%.
6. The change of water can be done at the time of need rather than waiting until the underground water table drops because the rain stops.
7. There is never a fall hazard, due to five feet, eight feet or ten feet of water being removed. People and animals that fall in a pool that is 95% drained, frequently drown. They are knocked unconscious or are so badly injured they drown.
8. The pool will weigh the same during the exchange, minus the total dissolved solids so there is little chance of the pool popping out of the ground

SUMMARY OF THE INVENTION

This device allows the safe changing of swimming pool water. It is needed because the process that causes the most catastrophic damage to a swimming pool, is changing or draining the pool water. The following is a math equation on the weight of water removed from a typical residential pool. Let's say the pool is 20 ft×40 ft width an average depth of 5 ft. Water weighs 62.3668 pounds per cubic foot. Multiplying length, times width, times depth, times the weight of water, this gives us the total weight of the water in the pool. (20×40×5×62.32668=249,467 pounds of water then divided by 2,000 gives us tons of water=124.7 tons) So a pool with these dimensions has over 124 tons of weight in it. When that much weight is removed, sometimes things move.

The foregoing, and other features and advantages of the invention, will be apparent from the following, more particular description of the preferred embodiments of the invention, the accompanying drawings, and the claims.

BRIEF DESCRIPTION OF THE DRAWINGS

For a more complete understanding of the present invention, the objects and advantages thereof, reference is now made to the ensuing descriptions taken in connection with the accompanying drawings briefly described as follows.

DETAILED DESCRIPTION OF PREFERRED EMBODIMENTS

Figure 1:
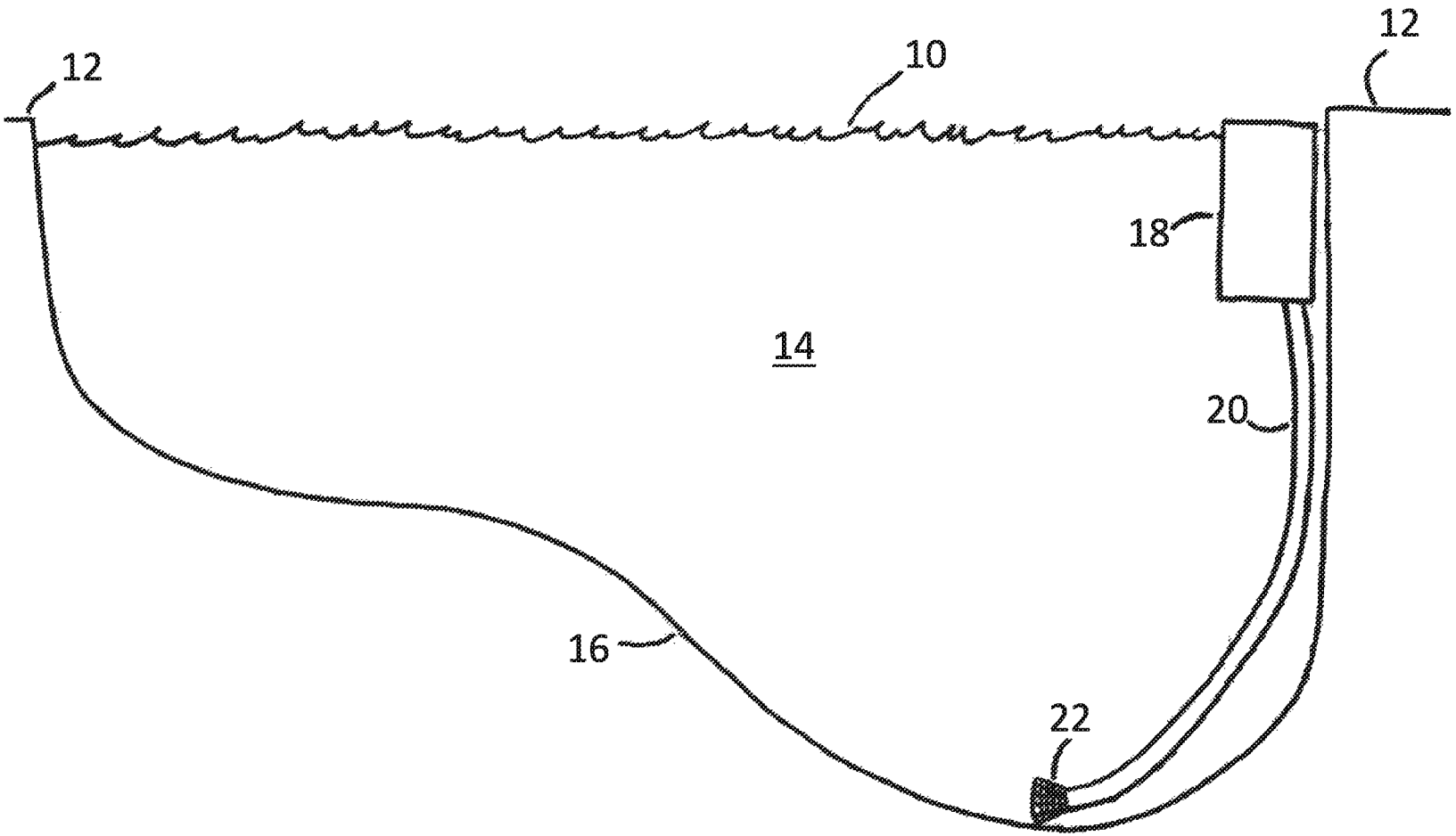
FIG. 1 is a sectional view of a swimming pool with an Open Top Box and a hard-suction line shown, according to an embodiment of the present invention.
Figure 2:
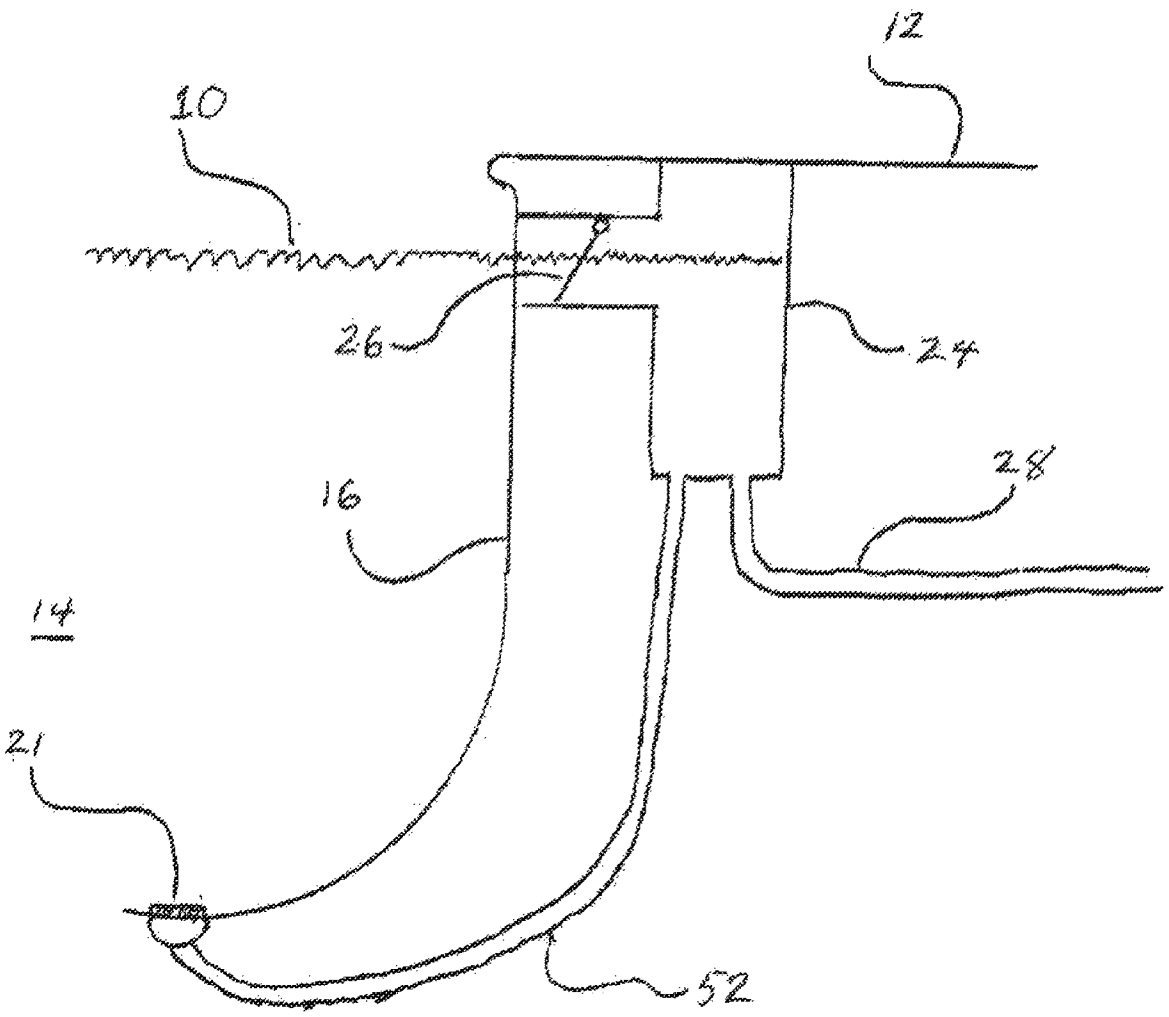
FIG. 2 is a sectional view of the skimmer, according to an embodiment of the present invention.
Figure 3:
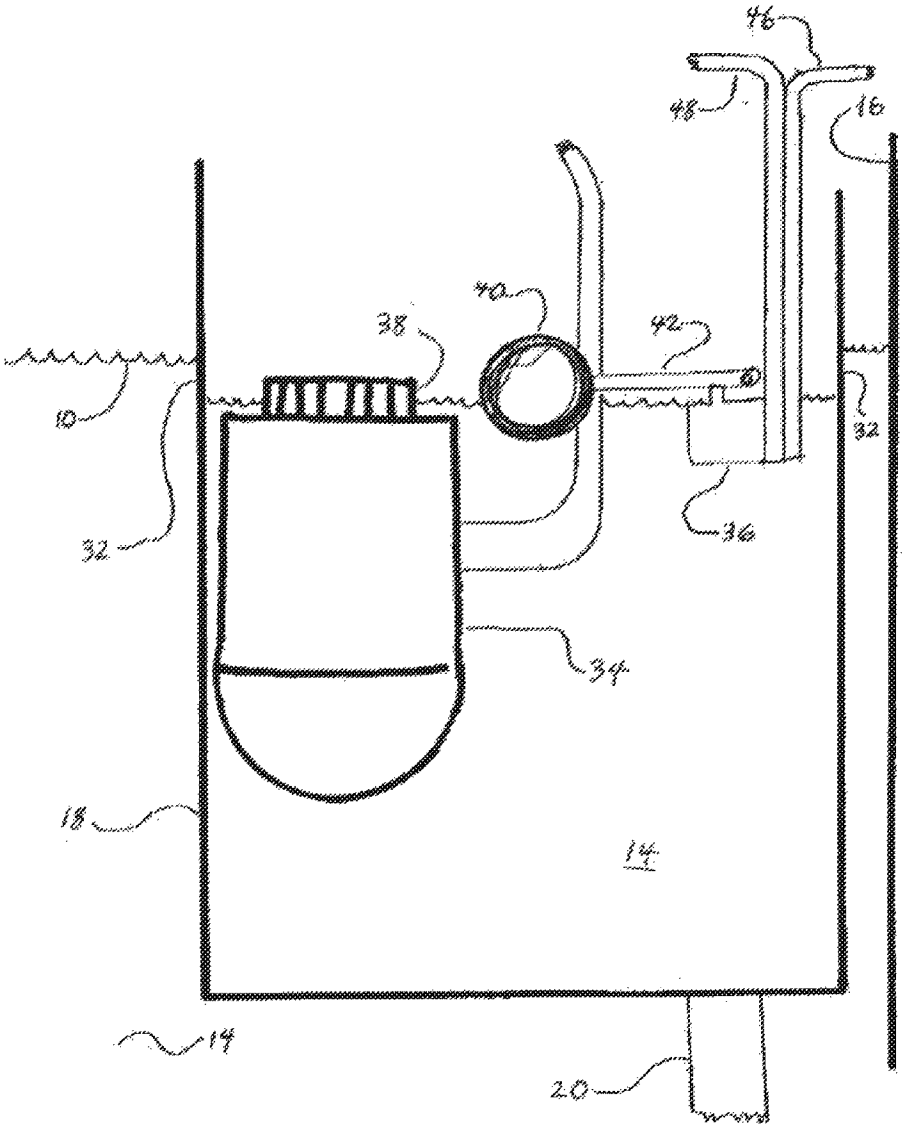
FIG. 3 is a sectional view of the Open Top Box, according to an embodiment of the present invention.
Figure 4:
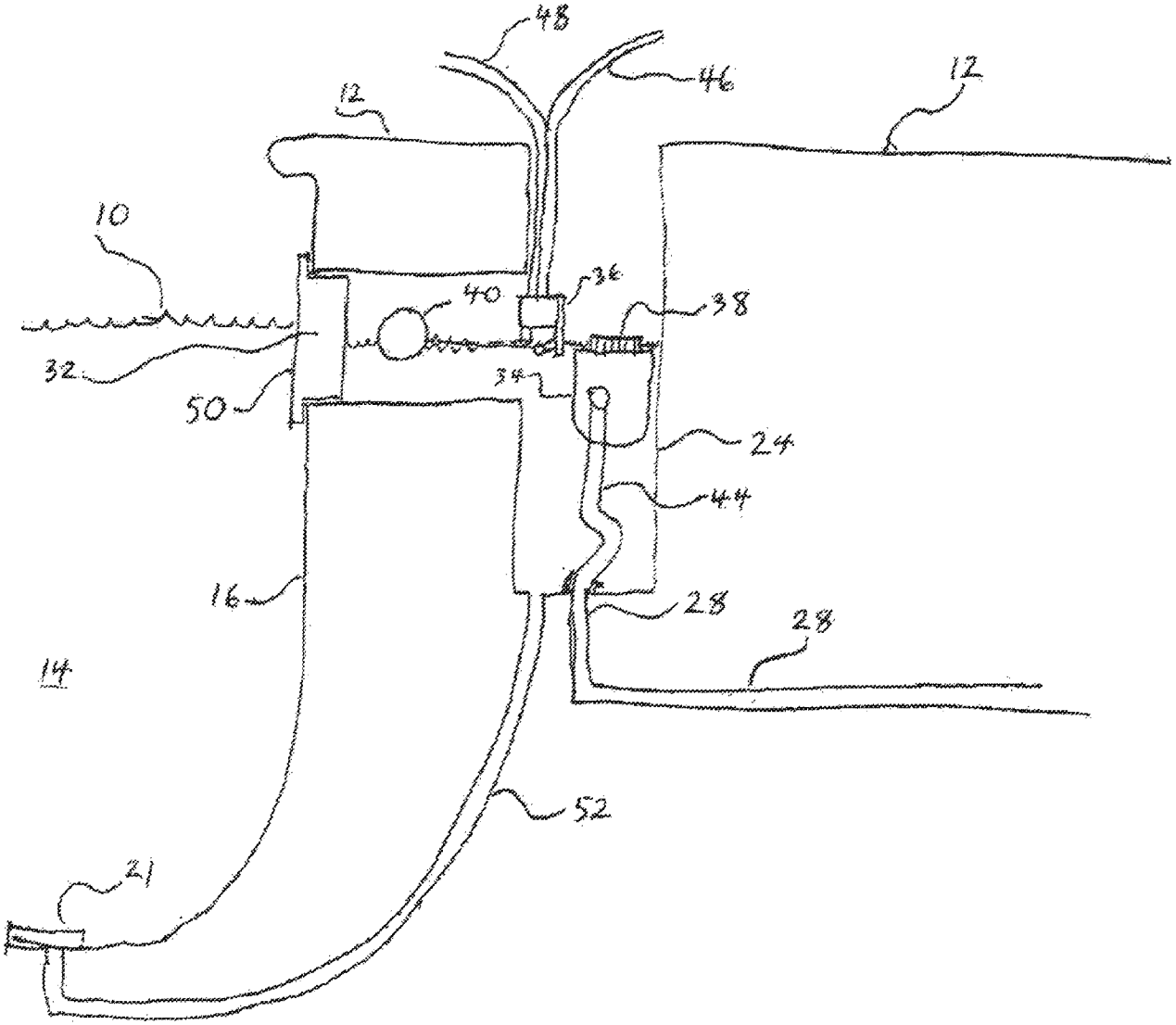
FIG. 4 is a sectional view of a skimmer body with a pump, float valve, weir plug, and a waste going to pool pump, according to an embodiment of the present invention.

Preferred embodiments of the present invention and their advantages may be understood by referring to FIGS. 1-13, wherein like reference numerals refer to like elements.

This system works by filling giant bags, that are put in the pool, with new fresh water. At the same time, the water outside the bags is pumped out through a pump placed in the Open Top Box. If the components are sized correctly the water being ejected will be at exactly the same rate the as the incoming water. Again, if the components are sized correctly, the bags can be filled at full blast, half throttle or a trickle and the system will be automatically self-regulating.

To achieve this self-regulating water exchange, a container I call the Open Top Box is created and placed within and at the side of the swimming pool. The Open Top Box is waterproof to the extent necessary. Within the Open Top Box is placed a pump and a float valve. The size and shape of the Open Top Box is controlled by how big a pump and float valve is to be mounted within. The Open Top Box is placed or mounted at the waterline of the pool approximately ¾ submerged. From the waste pump, inside the Open Top Box, is run a waste hose to waste. Connected to the outside of the Open Top Box is a large diameter pipe or tube. This tube runs from the Open Top Box to the deepest part of the swimming pool. Due to water seeking its own level, the water in the Open Top Box is the same level as outside of the Open Top Box. It acts as one body of water.

Now a bag or bags are placed inside the pool of such size and number that when full of fresh water all of the pool water is displaced. Next, hoses are run from each bag to an incoming fresh water manifold. This manifold has valves with which to control the amount of fresh water going to each bag. This manifold gets its supply of fresh water from the float valve mounted in the Open Top Box. The float valve gets its water from an electrical solenoid valve that is normally closed. This solenoid valve is held open when supplied with electricity. The solenoid valve gets its water from the fresh water supply. In operation, it functions like this. Fresh water comes to the platform holding the Open Top Box. At the platform is a solenoid valve. It is held open, electrically, by a tip switch on the platform. This tip switch controls the pump in the Open Top Box and the solenoid valve. The tip switch is a safety that will shut off both incoming and outgoing water if the mounting platform moves. This means if the platform is lifted by a water bag the system shuts down, or if the electrical power is shut off the system shuts down.

Next the water goes to the float valve in the Open Top Box. This float valve is a safety to prevent overfilling the pool. For example, if the pump stopped pumping, the water would continue to fill the pool until the float valve in the Open Top Box slowed and then shut off the incoming water.

When the float valve is open the incoming water goes out of the float valve to the fresh water hose manifold. At the manifold, the valves are set proportional to the size of the bag it is filling. The fresh water flows from the manifold in the garden hoses to each bag.

Next, the bags start to fill. They fill at the same rate as a normal hose would fill a pool. As the bags fill they displace water in the pool and the water level of the pool starts to rise. Because the Open Top Box is in the pool and a large tube is running to the deepest part of the pool, the water level inside the Open Top Box will also start to rise. As it rises the top of the water reach the mouth of the pump and start to be ejected.

The pump is now ejecting the heaviest water first. Meaning, if the water in the pool is salt water, the incoming fresh water will float on top of the old heavy salt water. This floating water is kept in bags separated from the old water. The bags will continue to fill and the waste pump will continue to eject waste water until all of the water is exchanged. Three controlling factors here are:

1. The waste pump must be able to keep up with the quantity of water the incoming fresh water hose supplies.

2. The Open Top Box needs to have enough depth to create the needed inches of water column pressure differential necessary for water flow.

3. The pipe, tube, or hose, going from the Open Top Box to the bottom of the pool, needs to be of sufficient diameter to allow the same quantity of water that is coming in to pass up from the bottom of the pool to the Open Top Box using only the pressure differential created by the Open Top Box. This means if four gallons per minute of fresh water are put in the bags, four gallons per minute of old water must be able to pass up the pick-up tube. This pressure differential is measured in inches of watercolumn, this means that two inches of water column pressure equals approximately only ¾ of one pound per square inch. It is the same amount of pressure that is read by a monometer, a very low-pressure gauge. This is the reason the waste water pickup tube must be a relatively large diameter.

If the components are sized correctly the system is self-regulating. If the incoming water is slowed, the water in the Open Top Box being ejected will also slow. If incoming water is increased the out-going water will soon increase.

Figure 8:
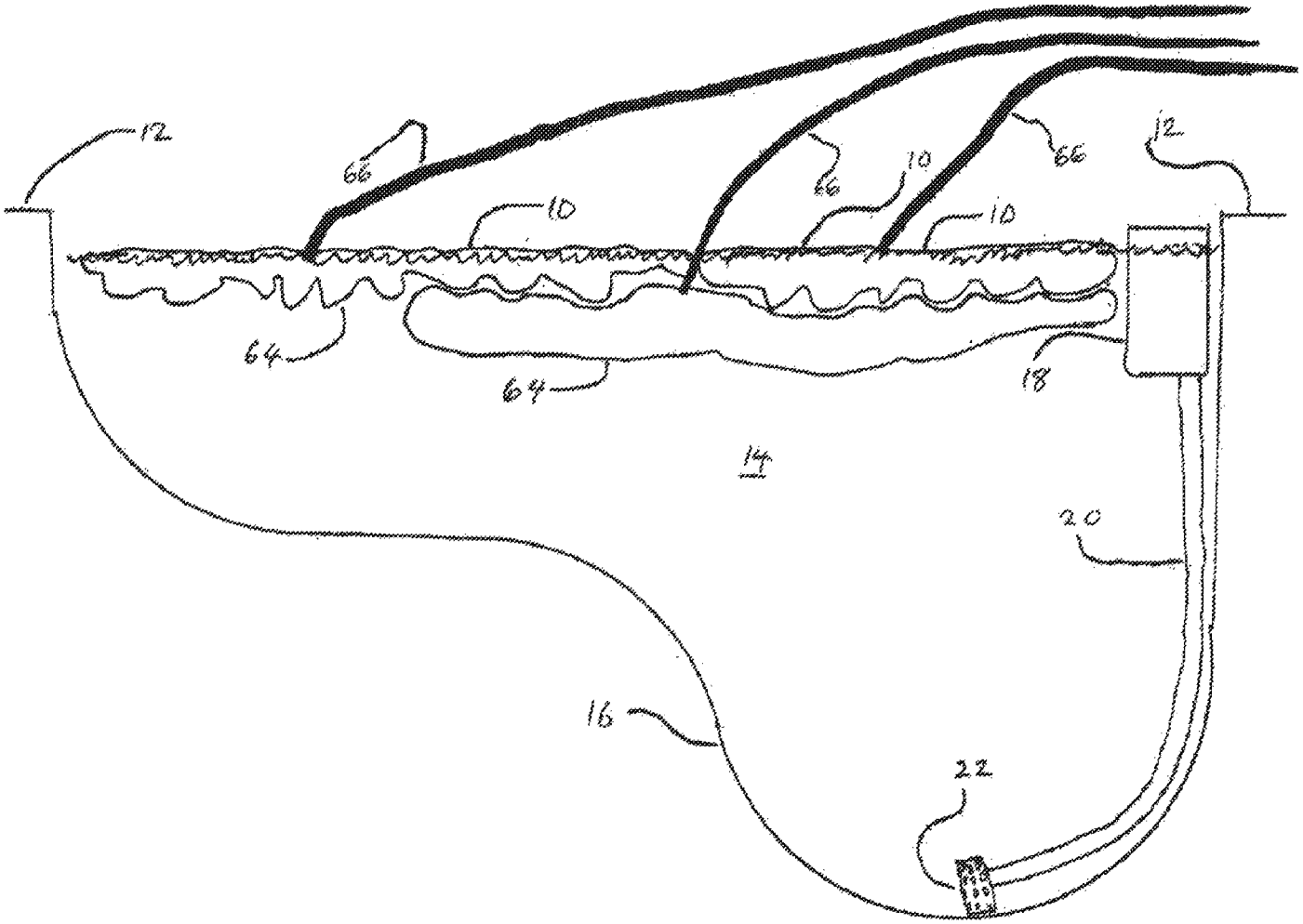
FIG. 8 is a sectional view pool starting its water exchange, according to an embodiment of the present invention.
Figure 9:
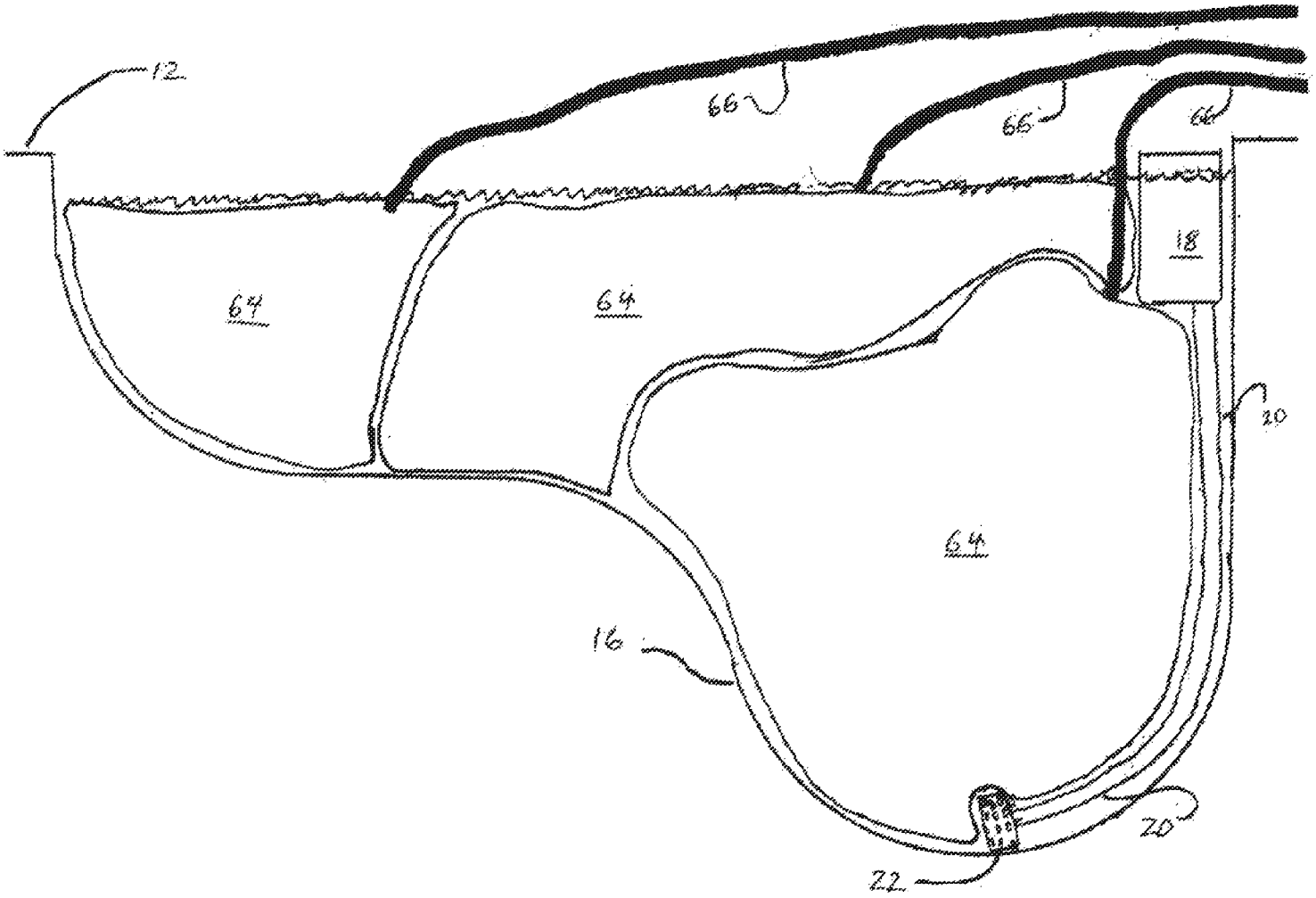
FIG. 9 is a sectional view pool finishing its water exchange, according to an embodiment of the present invention.
Figure 10:
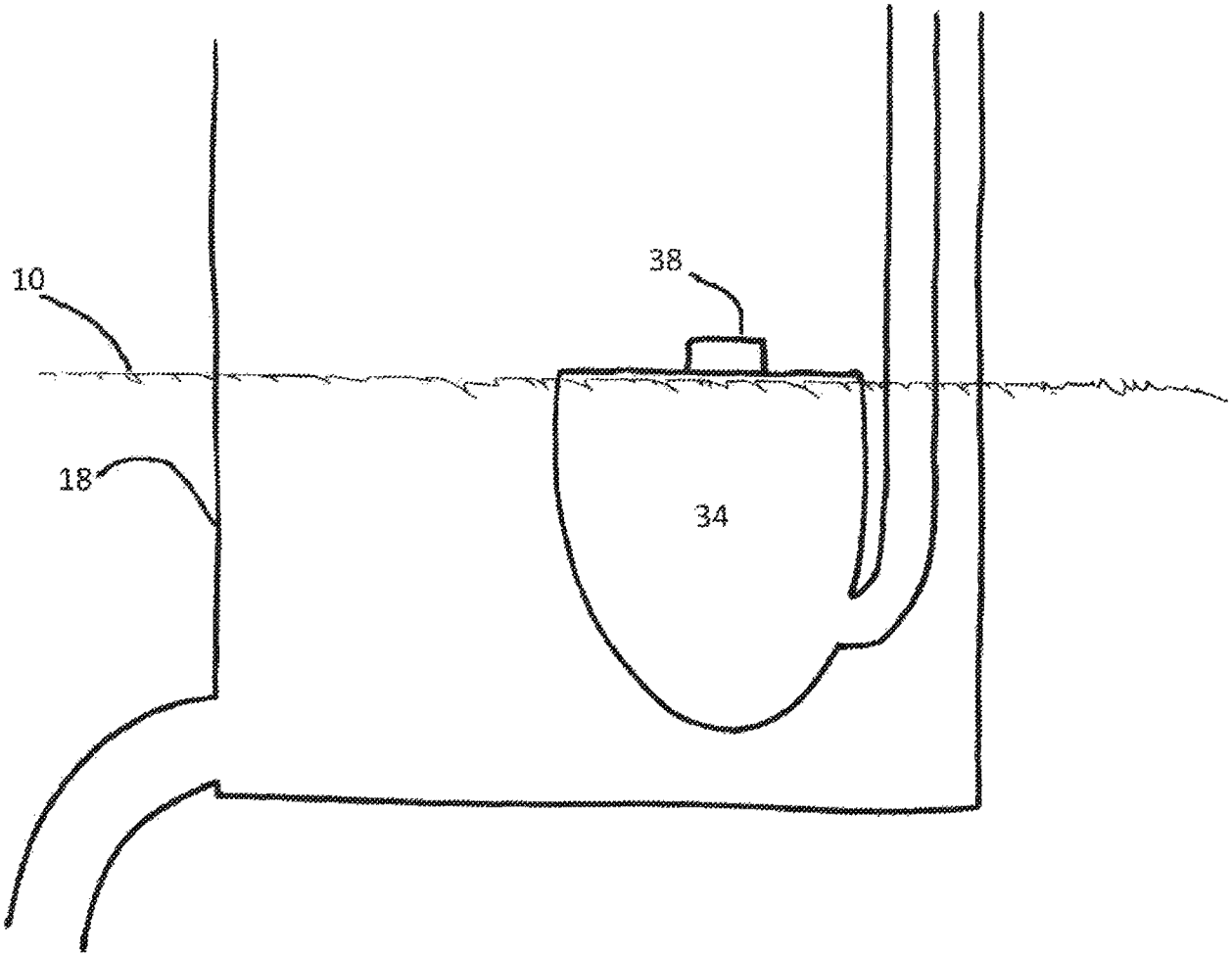
FIG. 10 is a sectional view of the Open Top Box with the pump in a full stop position, according to an embodiment of the present invention.
Figure 11:
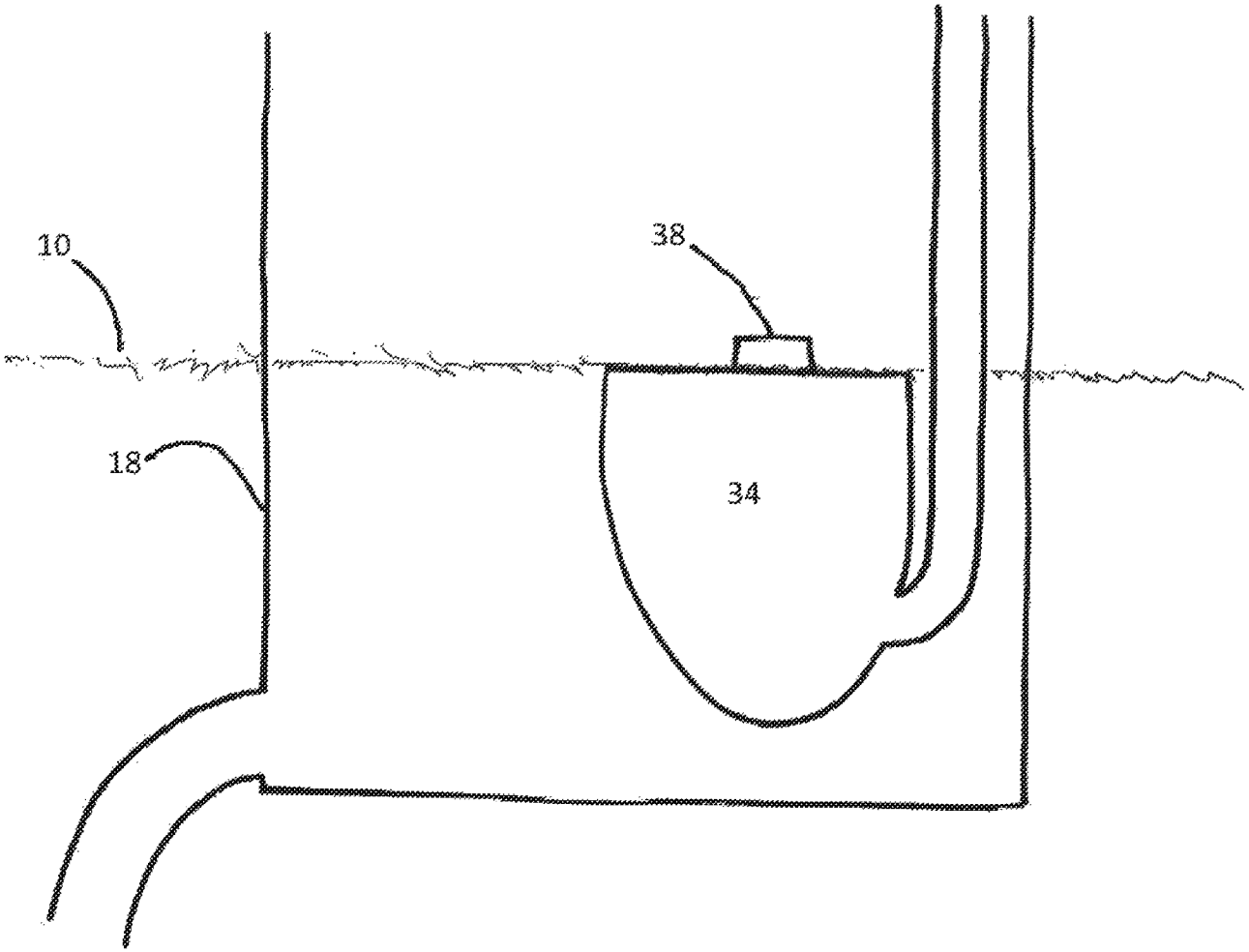
FIG. 11 is a sectional view of the Open Top Box with the pump in a just starting or just ending position, according to an embodiment of the present invention.
Figure 12:
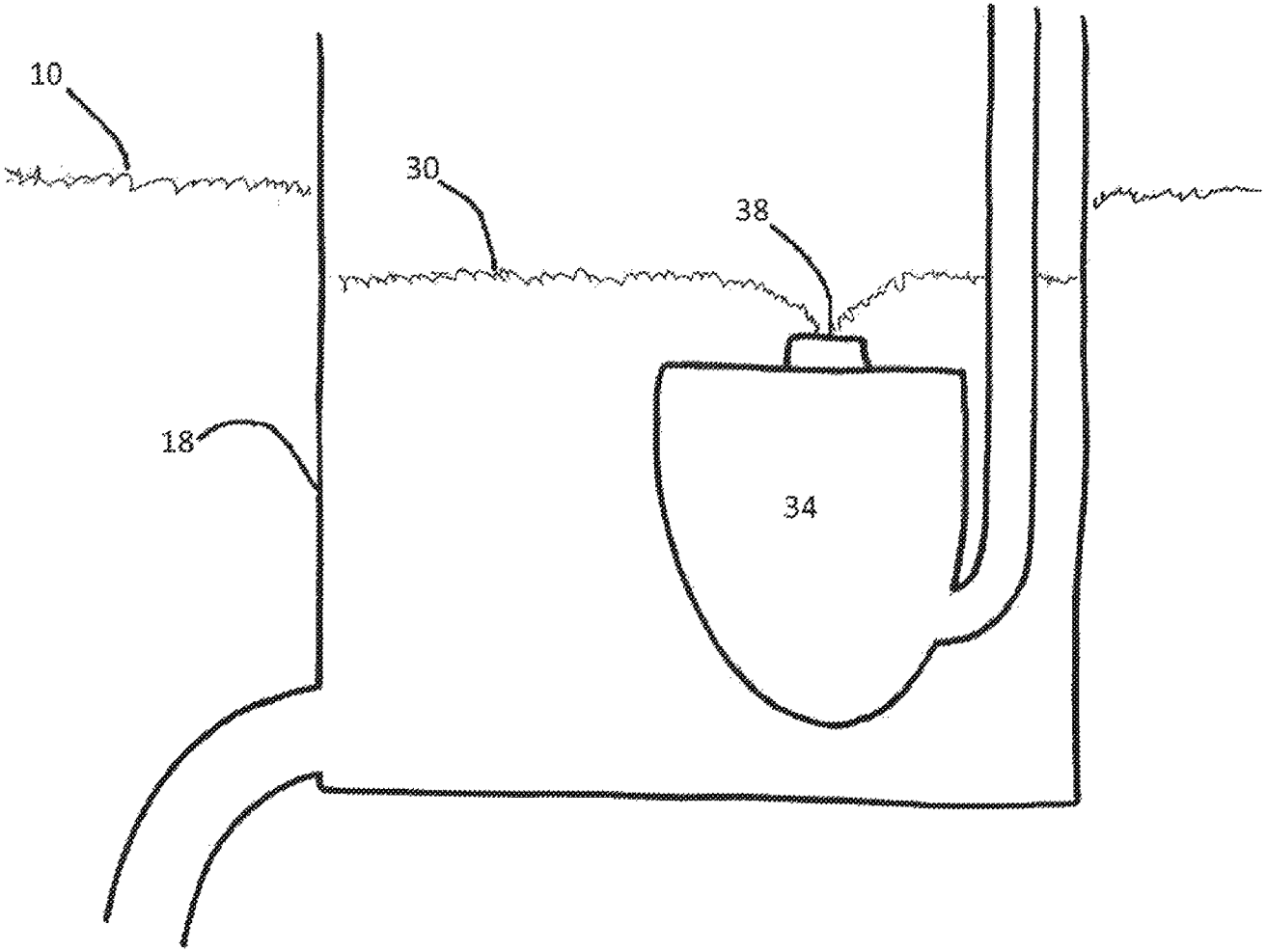
FIG. 12 is a sectional view of the Open Top Box with the pump in a normal operating position, according to an embodiment of the present invention.
Figure 13:
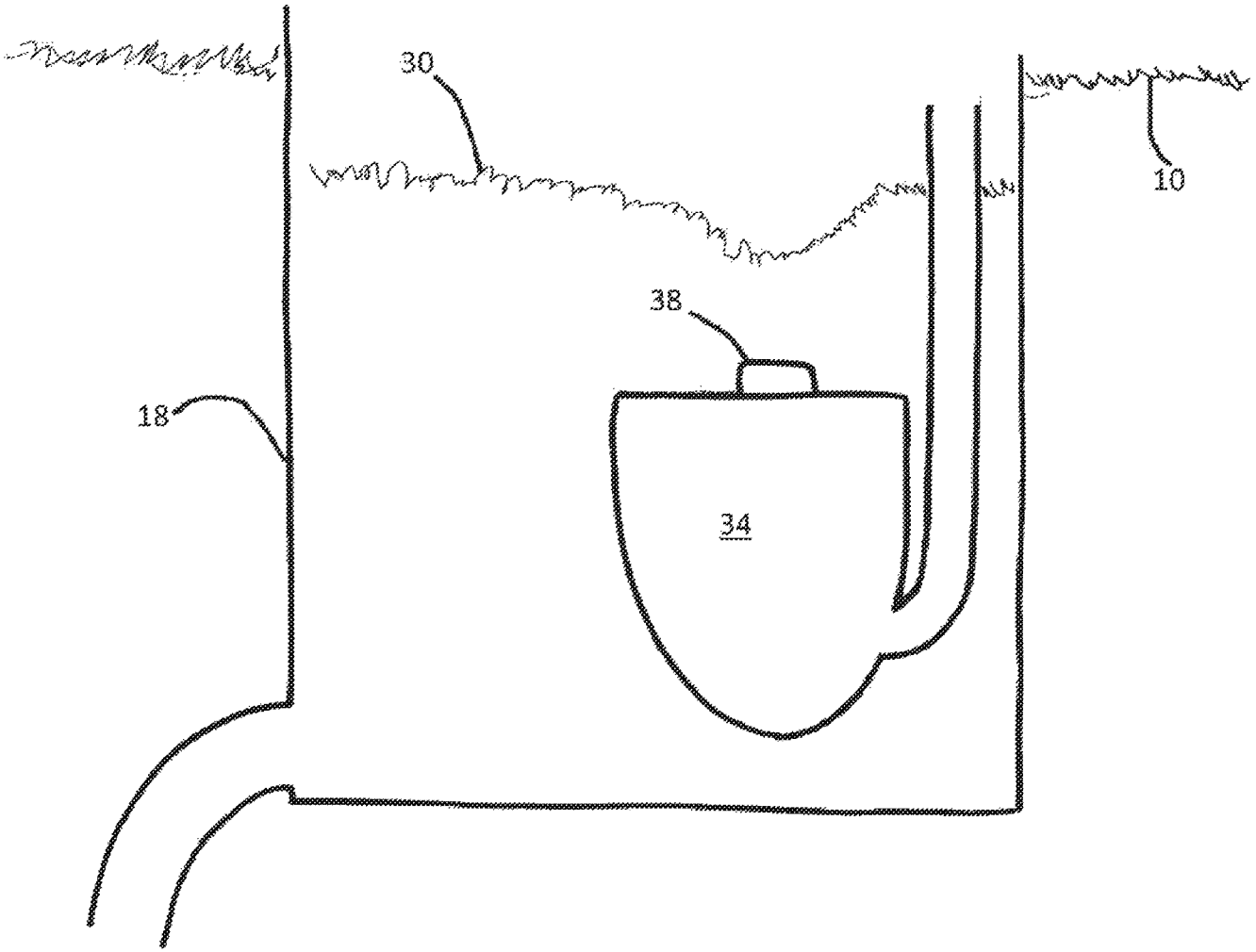
FIG. 13 is a sectional view of the Open Top Box with the pump in a full throttle position, according to an embodiment of the present invention.

In a first embodiment, as shown in FIG. 1, starts off with the waterproof box. This box needs to be big enough to allow, within, either the full body of a submergible pump or at least the mouth of an air-cooled pedestal pump. Also, this box should contain a float valve. This box also needs to be strong enough to withstand the crushing effects of the water bags as they fill. This box needs to allow access to the pump and float valve so an open top or a lid for this box is necessary, hence the name Open Top Box 18. This Open Top Box 18, or water exchange regulator, needs to be held in place and be able to resist the forces of the bags 64 filling as seen in FIG. 8 and FIG. 9. To that end I built a platform 60 shown in FIG. 7 that is placed on the deck 12 of the pool 16 and adjustable arms (56 and 62) connect the Open Top Box 18 with the platform 60. These arms (56 and 62) must be able to handle normal deck 12 to water level 10 differences. To this platform 60 is attached a tip switch (#58). The tip switch 58 cuts power to the waste pump 34 and to a normally closed solenoid valve 54. This tip switch 58 is to stop the water exchange if the platform 60 is moved or lifted. The system will operate without this safety switch. From the Open Top Box 18 is attached a large tube 20 shown in FIG. 1, running from the bottom of the pool to the side wall or bottom of the Open Top Box 18. This tube 20 is attached to and runs through the wall of the Open Top Box 18. This tube (#20) diameter should be large enough to allow the same gallons per minute of flow through it, as is coming in from the new water hose, yet using only the pressure differential 32 of the water pressure. If this hose is not big enough in diameter to allow sufficient flow, the incoming supply hose will need to have its volume reduced. This tube 20 also needs to be crush resistant, due to the huge amount of weight on the tube 20 when the bags 64 are full. Within this Open Top Box 18 is mounted a pump 34. It needs to be adjustable up and down within the Open Top Box 18 or the whole Open Top Box 18 must be able to be moved up and down. This is to increase or decrease the water column pressure 34 of the Open Top Box 18. Also within the Open Top Box 18, should be mounted a float valve 36. This float valve 36 is to reduce or stop the incoming fresh water. It should be mounted such that if the waste pump 34 is overwhelmed or fails for some reason, the filling of the pool will cease. The float valve 36 needs to be adjustable in height in relation to the mouth 38 of the waste pump 34.

The waste pump 34 must be sized to handle the gallons per minute of the incoming new water. The waste pumps 34 waste hose 44 must be sized to keep up with the incoming fresh water. This hose 44 must be able to handle the gallons per minute that the waste pump 34 puts out. The bags 64 need to be of sufficient size that the pool 16 can be filled with the bags 64 chosen. The water tightness of these giant bags is not of high importance. They need to fill to the point that they have some stress then leak. These bags are normally made out of woven polyethylene and will float. Both the bags 64 and the new water have lower specific gravity then the old water 14.

The supply hoses for the bags are regular garden hoses 66. The incoming fresh water supply hose manifold is an off the shelf garden hose splitter. A small cone and BB type of gallons per minute meter is used to do the job of setting the manifold valves.

Figure 5:
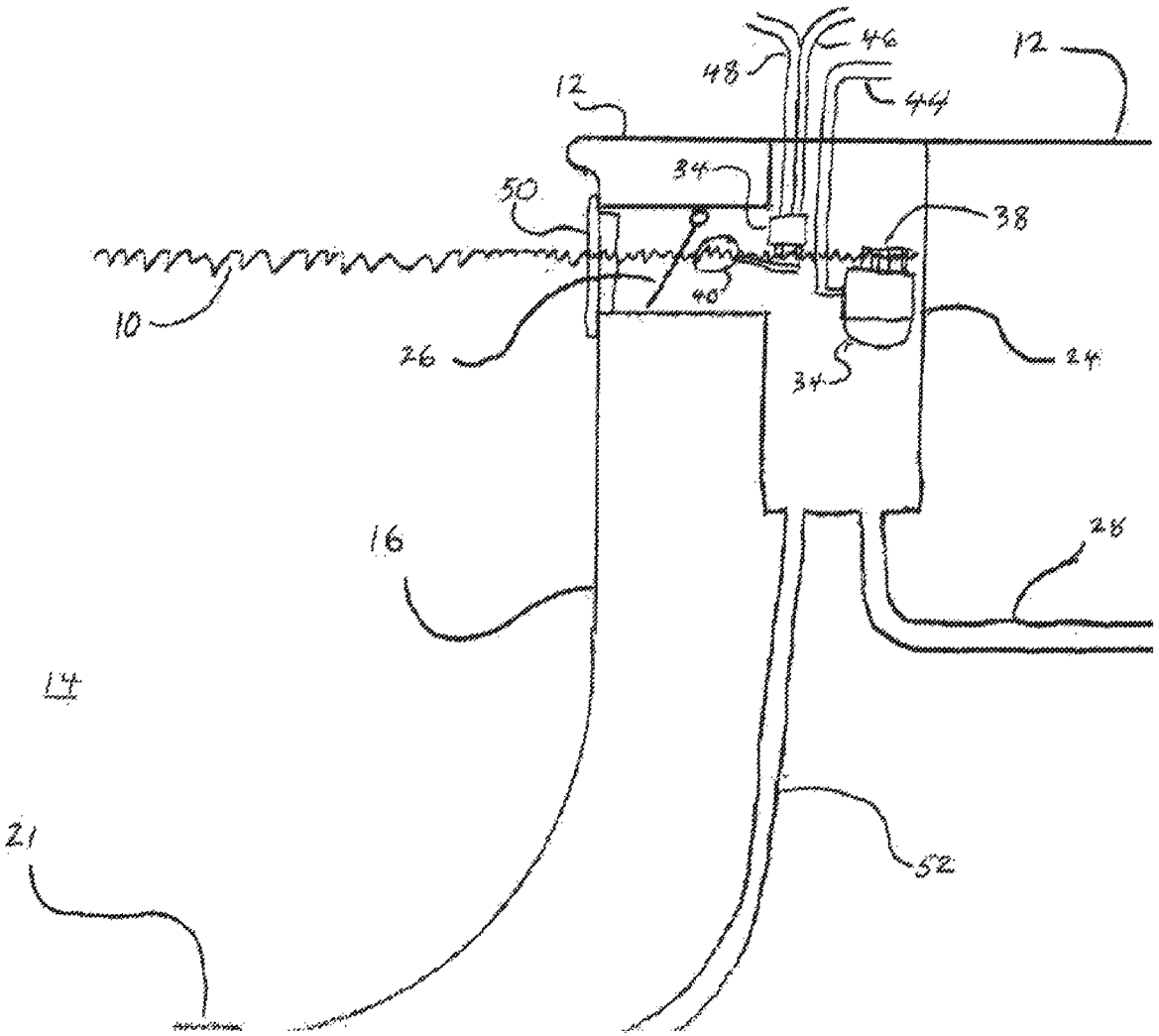
FIG. 5 is a sectional view of a skimmer body with a pump, float valve and with waste water going out to top to waste, according to an embodiment of the present invention.
Figure 6:
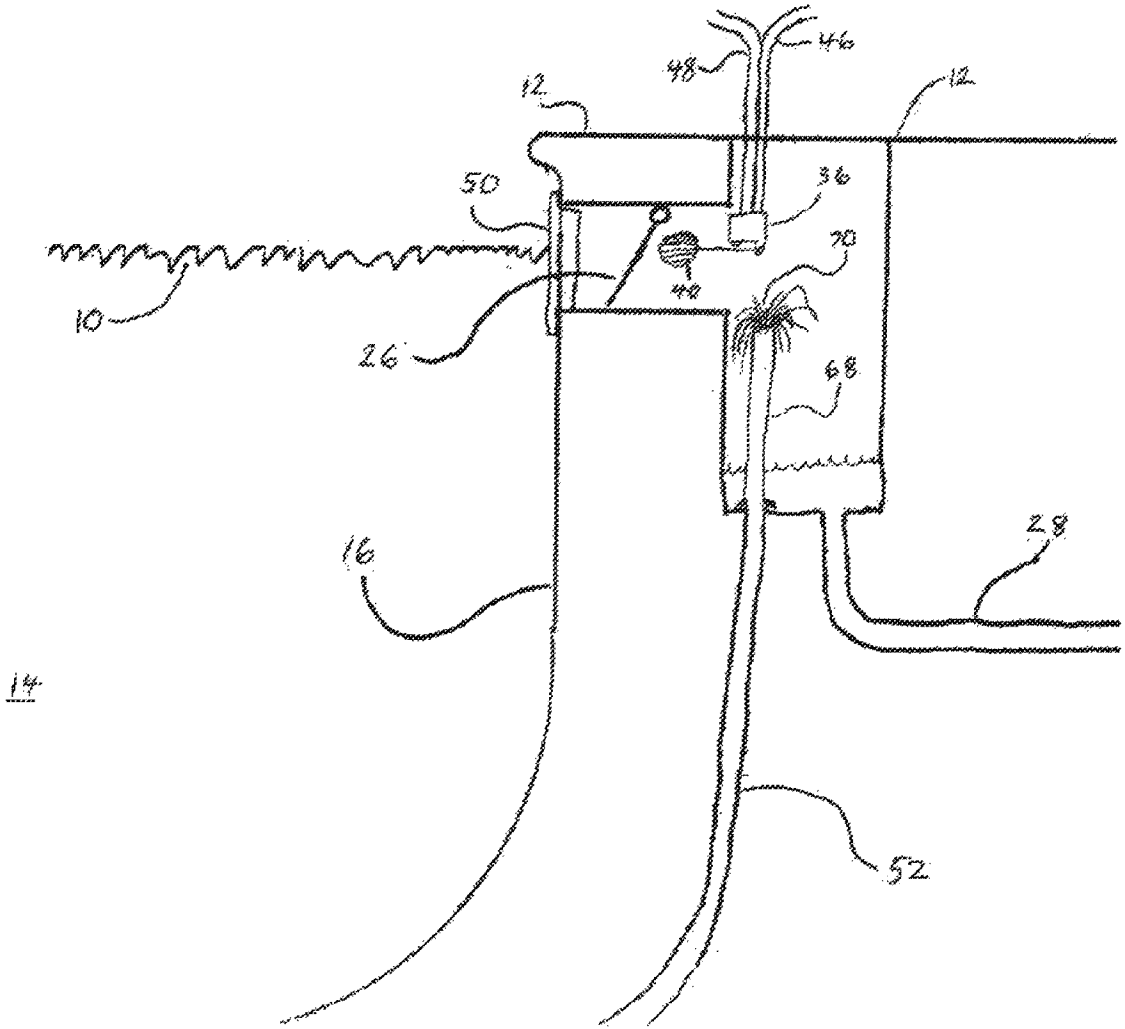
FIG. 6 is a sectional view of a skimmer body with a float valve, weir plug and short pipe installed in the main drain line, according to an embodiment of the present invention.
Figure 7:
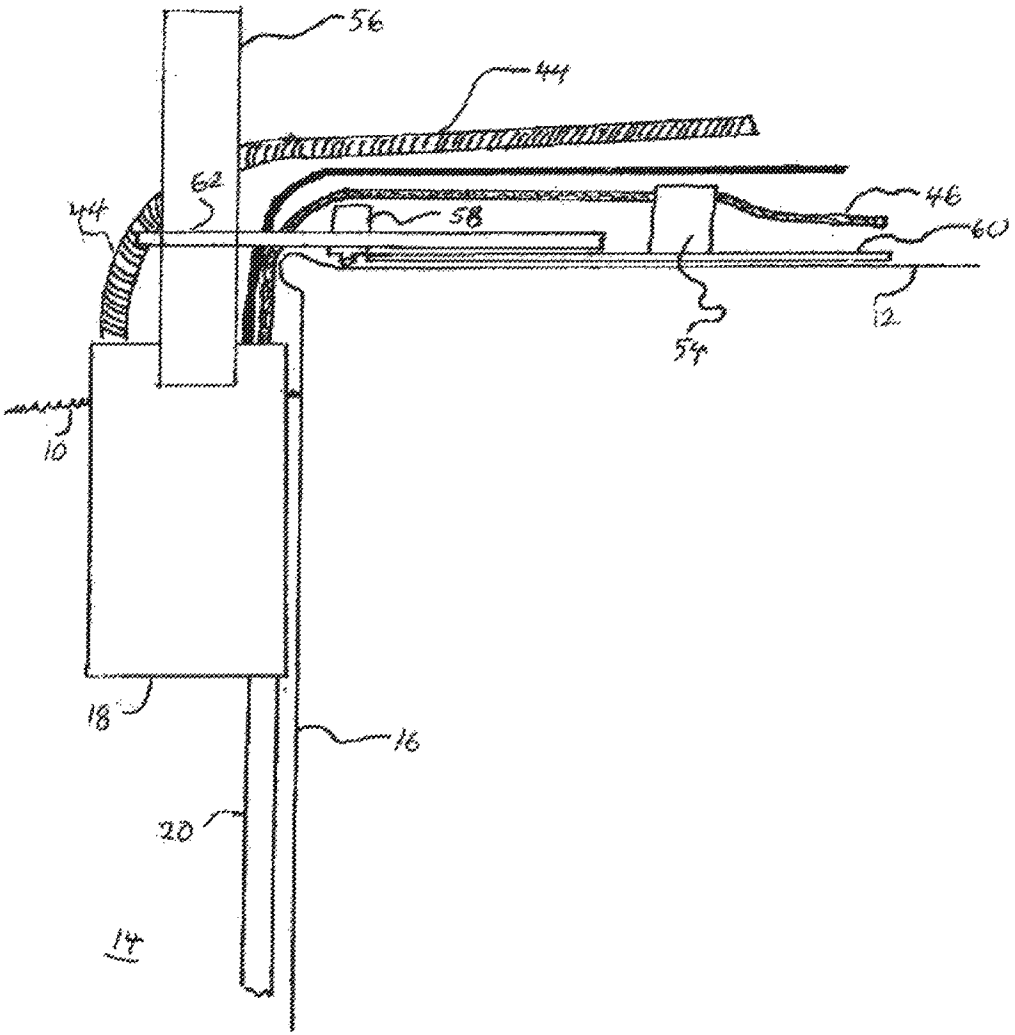
FIG. 7 is a perspective view of the Open Top Box, according to an embodiment of the present invention.

As shown in FIG. 5. This embodiment uses the skimmer box 24 as the Open Top Box 18. In this configuration, the main drain pipe 52 takes the place of the large diameter hose 20. A pedestal pump (not shown) is normally used instead of a submergible pump 34 and a smaller float valve 36 is used. A holding apparatus is necessary to hold the pump and float valve. The holding apparatus must be adjustable. A plug 50 is placed in the weir valve tunnel. This forces the displaced water, from the water bags 64, to go up the main drain pipe 52 into the skimmer box 24 and is ejected by the pedestal pump. The fill configuration of the water bags 64 is the same. This system will work without this float valve 36 acting as a safety.

In an embodiment, the main pool pump (not shown) is used as the waste pump 34. This requires that the water pump used to circulate the water in the pool be able to tolerate being in a constant state of prime. In this version, an extension tube 68 is inserted into the main drain line 52 in the skimmer box 24. The length of this tube determines the water column pressure 32 and the water level 10 of the pool. This tube 68 will keep the water level 10 in the pool similar to its normal level. A bag or bags 64 are filled in the body of the pool 16 and the pool pump (not shown) is set to run full time. Somewhere in the pool equipment, must be a splitter plumbed to waste. The weir valve tunnel must be plugged 50 and if possible a float valve 36 installed in the skimmer 24 to control incoming water. This system will work without this float valve acting as a safety.

In an embodiment, the waterflow up the main drain line 52 is created by the same differential pressure 32 that the Open Top Box 18 creates. In embodiment #2 the pumping effect is controlled by lowering the mouth 38 of the waste pump 34 inside the skimmer body 24. This will increase flow up to a point. That point is reached when the pump 34 reaches the bottom of the skimmer box 24. In embodiment #2 the main drain pipe 52 that is used to supply the waste pump 34 is a fixed size. This means, that do to this size restriction, the incoming water may over supply the water bags 64. The only solution is to restrict incoming water. This restriction can be created by putting a protected float valve 36 (not shown) in the main body of the pool 16 that limits the incoming water. The other way is to restrict the incoming water with a manual valve.

The same situation occurs in embodiment #3. The differential pressure 32 is created by pumping water out of the skimmer box 24. This is what the extension tube 68 inserted into the end of the main drain line 52 in the skimmer box 24 controls. By making the extension 68 shorter the water column pressure 32 is increased, up to the point that the extension 68 is reduced to nothing. At that point, as in embodiment #2, the incoming water must be slowed, again by a float valve 36 in the main body of the pool 16 or a manual valve.

The physical effect that is used is the pressure differential that is created by the Open Top Box and the position of the pump mounted within it. This pressure differential is what creates enough water flow to allow the pump to directly match the water supplied to the pool.

The ability of the system to self-regulate comes from the positioning of the pump in relation to the water level in the pool. When the pump mouth is located below the water level of the pool, pumping can occur and will occur until the level of the water in the pool falls below the level at which it can be pumped. The opposite can also occur, if the water level of the pool is below the mouth of the pump, pumping will not occur until the water level of the pool rises and brings the water level in the Open Top Box back up to the mouth of the pump.

The number one safety on the system is the float valve in the Open Top Box. And the number two safety is the tip switch. If the pump fails to pump, the water will continue to rise until the float valve activates and cuts off the incoming flow. The safety of the tip switch has to do with the heaving effect of the water bag. The water bag will lift the Open Top Box causing both the pump and the float valve to rise. This causes the system not to self-regulate. The tip switch prevents this scenario.

This means that if the Open Top Box, pump inside the Open Top Box and the float valve inside Open Top Box are set correctly, the system is self-regulating. This device uses the physical effect of water seeking its own level to create a self-regulating device. The incoming water can be turned up to full blast or down to a trickle and the system will self-regulate to that amount.

DRAWINGS/ILLUSTRATION KEY

10 Water level
12 Deck
14 Water
16 Pool wall
18 Open Top Box

20 Hard tube
21 Main floor drain
22 Strainer
24 Skimmer body
26 Weir valve
28 Suction pip
30 Lowered water in Open Top Box
32 Pressure differential zone
34 Pump
36 Float valve
38 Pump mouth
40 Float valve ball
42 Float valve arm
44 Waste hose
46 Fresh water in
48 Fresh water out manifold
50 Weir valve plug
52 Main drain pipe
54 Solenoid valve
56 Vertical arms
58 Tip switch
60 Platform
62 Platform arms
64 Water bags
66 Garden hoses
68 Short pipe
70 Water flow

I claim:

1. A method for exchanging pool water of a swimming pool comprising:

a. placing one or more expandable bags, connected to a fresh water supply, into the swimming pool b. supplying the one or more expandable bags with fresh water;

c. removing old water from the swimming pool with a pump, having a pump mouth, provided in an open top box received by a platform mounted on a swimming pool deck at a side of the swimming;

d. maintaining a waterline within the open top box, wherein the old water will not be pumped when the waterline falls below the pump mouth inside the open top box, and wherein a float valve will cut off the fresh water supply when the waterline raises the float valve inside the open top box; and e. emptying fresh water contents of the one or more expandable bags into the swimming pool.

2. The method as recited in claim 1, wherein the one or more expandable bags are connected to the fresh water supply by a hose.

3. The method as recited in claim 1, wherein one or more tubes define a water path from the bottom of the swimming pool to the open top box.

4. The method of claim 3, wherein the one or more tubes transport water from the bottom of the swimming pool to the open top-box due to a static pressure differential between the inside of the open top box the outside of the open top waterproof box.

* * * * *